US009988581B2

(12) United States Patent
Meyer

(10) Patent No.: US 9,988,581 B2
(45) Date of Patent: Jun. 5, 2018

(54) CRUDE OIL STABILIZATION AND RECOVERY

(71) Applicant: Aspen Engineering Services, LLC, Golden, CO (US)

(72) Inventor: James M. Meyer, Golden, CO (US)

(73) Assignee: Aspen Engineering Services, LLC, Golden, CO (US)

( * ) Notice: Subject to any disclaimer, the term of this patent is extended or adjusted under 35 U.S.C. 154(b) by 0 days. days.

(21) Appl. No.: 15/671,853

(22) Filed: Aug. 8, 2017

(65) Prior Publication Data

US 2017/0335205 A1 Nov. 23, 2017

Related U.S. Application Data

(63) Continuation-in-part of application No. 14/663,064, filed on Mar. 19, 2015, now Pat. No. 9,758,735.

(60) Provisional application No. 61/955,555, filed on Mar. 19, 2014.

(51) Int. Cl.

| | |
|---|---|
| ***C10G 31/06*** | (2006.01) |
| ***C10G 53/02*** | (2006.01) |
| ***C10G 33/00*** | (2006.01) |
| ***C10G 7/00*** | (2006.01) |
| ***C10G 7/02*** | (2006.01) |

(52) U.S. Cl.
CPC ..... *C10G 31/06* (2013.01); *C10G 7/00* (2013.01); *C10G 7/02* (2013.01); *C10G 33/00* (2013.01); *C10G 53/02* (2013.01)

(58) Field of Classification Search
CPC ..... C10G 31/06; C10G 33/00; C10G 53/02
See application file for complete search history.

(56) References Cited

U.S. PATENT DOCUMENTS

| | | | | |
|---|---|---|---|---|
| 7,350,581 | B2 | 4/2008 | Wynn | |
| 2004/0238412 | A1* | 12/2004 | Runbalk | C10G 7/00 208/340 |

FOREIGN PATENT DOCUMENTS

| | | | |
|---|---|---|---|
| EP | 0213791 | A2 | 3/1987 |
| WO | WO 98/17941 | A1 | 4/1998 |

* cited by examiner

*Primary Examiner* — Randy Boyer
*Assistant Examiner* — Juan C Valencia
(74) *Attorney, Agent, or Firm* — Thorpe North Western, LLP

(57) ABSTRACT

Volatile organic compounds are removed from crude oil by adding heat upstream of a vapor recovery tower. The heat input may either be sufficient to break the emulsion as in a here treater or extra heat may be added to stabilize the crude oil. Produced gas may be recovered as NGL in one or more cooling stages. Produced gas, whether partially recovered or not, may be used as fuel for said heater treater, other combustion device or compressed into a pipeline.

6 Claims, 2 Drawing Sheets

CRUDE OIL STABILIZATION AND RECOVERY

RELATED APPLICATION

This application is a continuation-in-part of U.S. patent application Ser. No. 14/663,064, filed Mar. 19, 2015 which claims the benefit of U.S. Provisional Patent Application No. 61/955,555, filed Mar. 19, 2014.

FIELD OF INVENTION

This invention relates generally to hydrocarbon recovery from crude oil storage tanks.

BACKGROUND

Volatile emissions from crude oil in stock oil tanks is regulated by the Environmental Protection Agency's New Source Performance Standards (NSPS, 40 CFR Part 60 Subpart OOOO dated Aug. 16, 2012). The NSPS applies to storage tanks used in oil or natural gas production with the purpose of reducing toxic air pollutants and Volatile Organic Compound (VOC) emissions. Concurrently, recent reports indicate that crude oil from new shale plays have become a transportation safety risk. The concern is that the high volatility, measured by the Reid Vapor Pressure (RVP), from the Bakken Shale formation in North Dakota and the Eagle Ford Shale formation in Texas had RVP readings over eight pounds per square inch (PSI), and that some wells were producing oil with RVP readings as high as 15 PSI. A series of recent volatile crude oil railcar accidents have resulted in fires and deaths. Volatility risk also increases when crude oil is produced in a cold climate, and then shipped to a warm climate, because crude oil volatility increases exponentially with temperature. Consequently, oil and transportation industries are seeking solutions to reduce crude oil volatility and storage tank emissions.

Crude oil from a wellhead separator contains a copious amount of emulsified water at a pressure of 30 to 70 pounds per square inch gauge. The crude oil is sent to a heater-treater to break the oil and water emulsion. The separated crude oil is subsequently delivered to a stock oil storage tank, operated at ambient pressure. The transfer of crude oil from a hot, pressurized heater-treater to the ambient storage tank causes a substantial amount of VOC to vaporize as fugitive emissions. The NSPS regulation requires recovery of the VOC if emissions exceed 6 tons per year. The fugitive emissions contain a substantial amount of natural gas liquid (NGL) and natural gasoline. A Vapor Recovery Tower (VRT) upstream of the storage tanks may be used to separate the VOC from the crude oil. The VOC may be either burned or recovered in a vapor recovery unit (VRU). Vapor recovery units simply collect hydrocarbons from the vapor recovery tower, then compress the gas for transfer to a natural gas pipeline. However, about one-third of the wells in North Dakota are not connected to a pipeline. In such cases, the crude oil is transferred from the storage tanks to a transport tank (e.g. railcar tanks, tanker trucks, etc). For the wells that are connected to a pipeline, valuable hydrocarbons are sold at a discount when blended with natural gas.

SUMMARY OF THE INVENTION

A new process of crude oil stabilization and recovery (COSR) at a wellhead is capable of reducing the crude oil volatility while enabling simpler compliance with the New Source Performance Standard. In this process, crude oil is stabilized by adding stabilization energy into crude oil and/or by recovering and condensing vapors from tank vent gas. Concurrently, pressure may be reduced in the heater-treater to facilitate hydrocarbon vaporization. The stabilization energy for the crude oil may be added directly to the heater-treater, the vapor recovery tower, the storage tank or in a heater added to interconnecting piping between these units. Volatile components are flashed from the crude oil to reduce the vapor pressure of the crude oil.

The gas that vaporizes from the crude oil may be cooled with the resulting gas, NGL and water separated. The separated gas may be compressed and cooled with the resulting gas, NGL and water separated a second time. The resulting gas may be consumed in the heater treater, another combustion device or delivered to a pipeline.

There has thus been outlined, rather broadly, several features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

DETAILED DESCRIPTION

Figure 1:
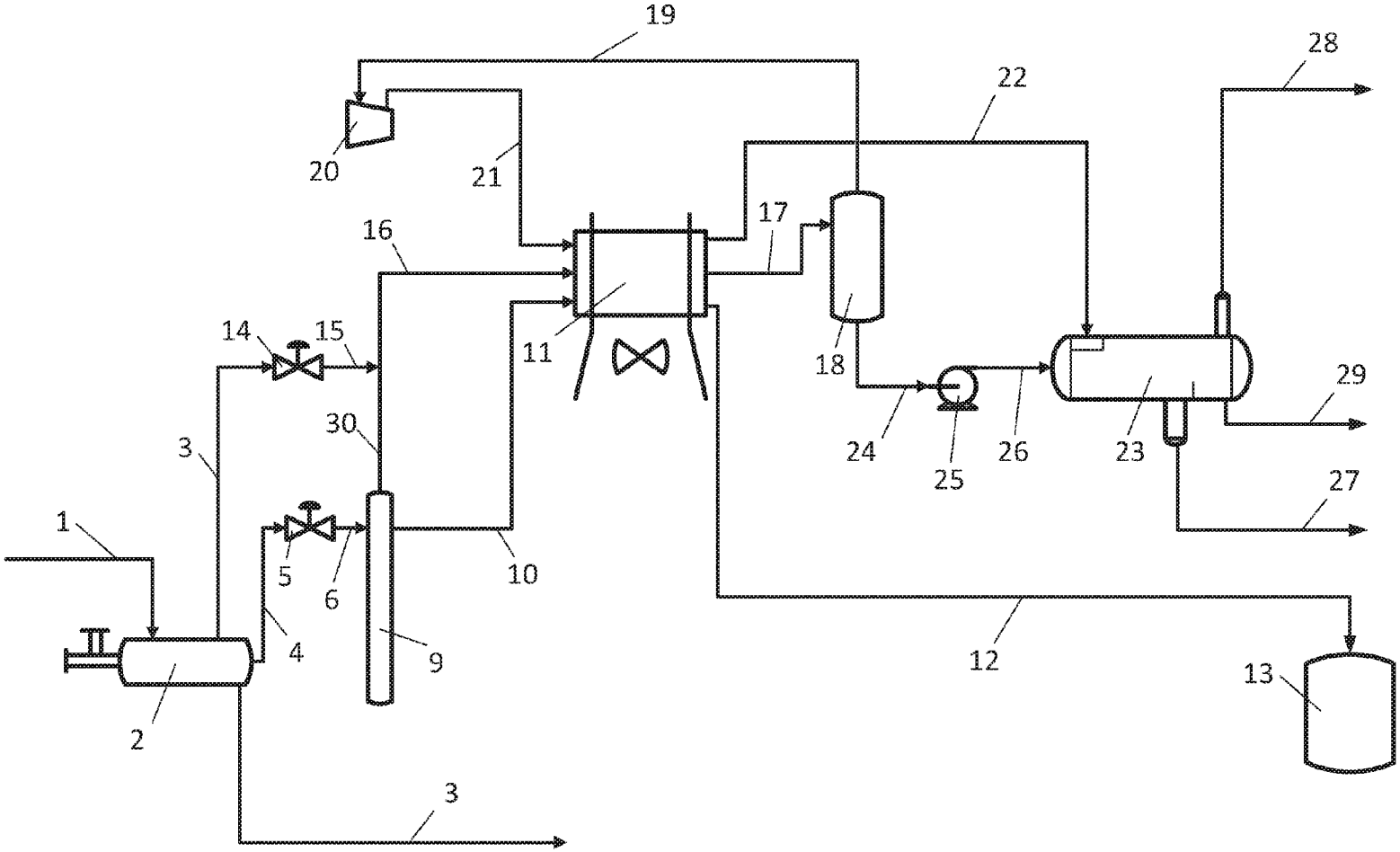
FIG. 1 is a process flow diagram for a COSR system with a vapor recovery tower in accordance with an example of the present invention.

Embodiments of crude oil stabilization and recovery systems according to the present invention utilize stabilization energy added upstream of the crude oil storage tank at a wellhead. The stabilization energy vaporizes volatile components, thereby reducing the crude oil volatility. More specifically, raw emulsified crude oil recovered from a well can be sent to a conventional wellhead separator which separates emulsified crude oil from rock and other materials. The emulsified crude oil can then be directed to a heater-treater which is operated to break the emulsion and form a crude oil and a water product. Although water content can vary depending on temperature (e.g. upwards of 20 mole %), a de-emulsified crude oil can typically have less than 2 mole %, and often less than 1 mole % water. The stabilization energy can be added sufficient to further remove VOC and other fugitive vapors from the crude oil to form a stabilized crude oil.

The vaporized components can be cooled by a first air cooler, and the resulting gas, NGL and water flow into a first separator where gas is separated from NGL and water. Gas from the first separator is compressed, and the compressed gas is sent to a second air cooler where partial condensation of liquids occurs. The resulting gas, NGL, and water are collected in a second separator. The secondary separator separates the gas, NGL and water into separate streams. Alternatively, the compressed gas from the primary separator may be sent to a pipeline or simply combusted. The NGL streams from the primary and the secondary separator are combined for storage, transport and sale.

A natural gas-fired heater, known to the industry as a heater treater, can be used to break the oil water emulsion.

The heater treater can serve a dual purpose by stabilizing the oil. An additional auxiliary heater downstream of the heater treater can be used to provide supplemental energy. The primary separator can be a two-phase gas/liquid separator whereby gas leaves the top of the vessel, and liquid is discharged from the bottom of the vessel. The secondary separator can be a three-phase gas/liquid/liquid separator whereby gas leaves the top of the vessel, the light oil phase overflows an internal weir and discharges from the bottom of the vessel downstream of the weir. The heavy liquid is discharged from the bottom of the vessel upstream of the internal weir.

If the crude oil volatility meets regulatory requirements, then vapor from the heater treater and/or crude oil tank may be compressed and delivered to the heater-treater or other combustion device for fuel.

The crude oil stabilization and recover system can be fluidly connected to a wellhead separator and/or wellhead. Thus, the system is designed to produce a stabilized crude oil for storage in a stock oil storage tank at the wellhead. Crude oil from this stock oil storage tank can be transported to a refinery through a long-distance pipeline and/or delivered into a transport tank (e.g. railcar or tanker). Accordingly, in some cases the crude oil stabilization and recovery system is fluidly isolated from a refinery. In other cases, the crude oil stabilization and recovery system can be fluidly connected only through a long-distance pipeline of greater than 0.25 miles, and most often greater than 50 miles. Accordingly, a pipeline distance between the heater-treater and the stock oil storage tank can be less than 0.25 miles, and most often less than about 300 yards.

Terminology

The terms and phrases as indicated in quotation marks (“ ”) in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term “or” as used in this specification and the appended claims is not meant to be exclusive; rather the term is inclusive, meaning either or both.

References in the specification to “one embodiment”, “an embodiment”, “another embodiment”, “a preferred embodiment”, “an alternative embodiment”, “one variation”, “a variation” and similar phrases mean that a particular feature, structure, or characteristic described in connection with the embodiment or variation, is included in at least an embodiment or variation of the invention. The phrase “in one embodiment”, “in one variation” or similar phrases, as used in various places in the specification, are not necessarily meant to refer to the same embodiment or the same variation.

The term “couple” or “coupled” as used in this specification and appended claims refers to an indirect or direct physical connection between the identified elements, components, or objects. Often the manner of the coupling will be related specifically to the manner in which the two coupled elements interact.

The term “stabilized crude oil” means crude oil with a vapor pressure low enough to comply with transport and storage regulations, which is currently 13.7 psia for transportation and 11.1 psia for storage in floating roof tanks at 70° F.

The term “single-stage cooling” means that the tank vent vapors are only cooled once during the process and within the system.

The term “two-stage cooling” means that the tank vent vapors are cooled twice successively in either a partitioned cooler or two separate coolers.

The term “stabilization energy” means energy added to crude oil exceeding the energy requirement for separating oil and water in the heater-treater.

The term “partitioned section” refers to a section of a heat exchanger with a barrier to prevent mixing of fluids flowing through said heat exchanger.

The term “volatility” refers to the Reid Vapor Pressure of a liquid.

The term “three-phase separator” refers to a vessel capable of separating a gas phase, hydrocarbon phase and aqueous phase into dedicated outlets.

The term “two-phase separator” refers to a vessel capable of separating a gas phase from a liquid phase into dedicated outlets.

The term “blower” refers to a device that produces a current of air at a low differential pressure using a centrifugal pump or fan blades. Typically, a low differential pressure include pressure differences less than about 25 psi.

The term “compressor” refers to a high differential pressure gas compression devices, including screw compressors, scroll compressors and reciprocal compressors. Typically, high differential pressure includes a pressure difference of at least 25 psi.

The term “NGL” refers to hydrocarbon liquid condensed from the air cooler.

The term “scrubber” refers to a two-phase separator.

A First Embodiment Crude Oil Stabilization and Recovery System

FIG. 1 depicts an embodiment of the COSR process. Crude oil 1 flows into heater-treater 2 where stabilization energy is added to vaporize volatile hydrocarbons and reduce the remaining crude oil volatility. Water 3 is decanted from the bottom of heater-treater 2, and stabilized crude oil 4 is depressurized through valve 5. A two-phase vapor/liquid stream 6 from valve 5 flows into vapor recovery tower 9, where gas separates from crude oil. Crude oil 10 flows from vapor recovery tower 9 through a first partition of air cooler 11. Cooled, stabilized crude oil 12 from partitioned air cooler 11 flows into storage tank 13. Gas stream 3 from heater treater 2 is depressurized through valve 14. A gas stream 15 from valve 14 is mixed with gas stream 30 from vapor recovery tower 9, forming stream 16. Stream 16 flows into a second partition of air cooler 11 where partial condensation occurs. Two-phase stream 17 flows from the second partition of cooler 11 into first separator 18. Gas stream 19 from primary separator 18 flows into compressor 20. Compressed gas 21 from compressor 20 flows into a third partition of air cooler 11. A two-phase stream 22 from the third partition of air cooler 11 flows into second separator 23. Liquid stream 24 flows into pump 25. Stream 26 from pump 25 is mixed with stream 22 in separator 23. Gas, NGL and water are separated in second separator 23. Water 27 is removed from the bottom of separator 23. Gas stream 28 from the three-phase separator 23 is consumed as fuel in heater-treater 2, combusted in other devices, or delivered to a pipeline. The combined NGL 29 from streams 26 and 22 is removed from three-phase separator 23.

A Second Embodiment Crude Oil Stabilization and Recovery System

Figure 2:
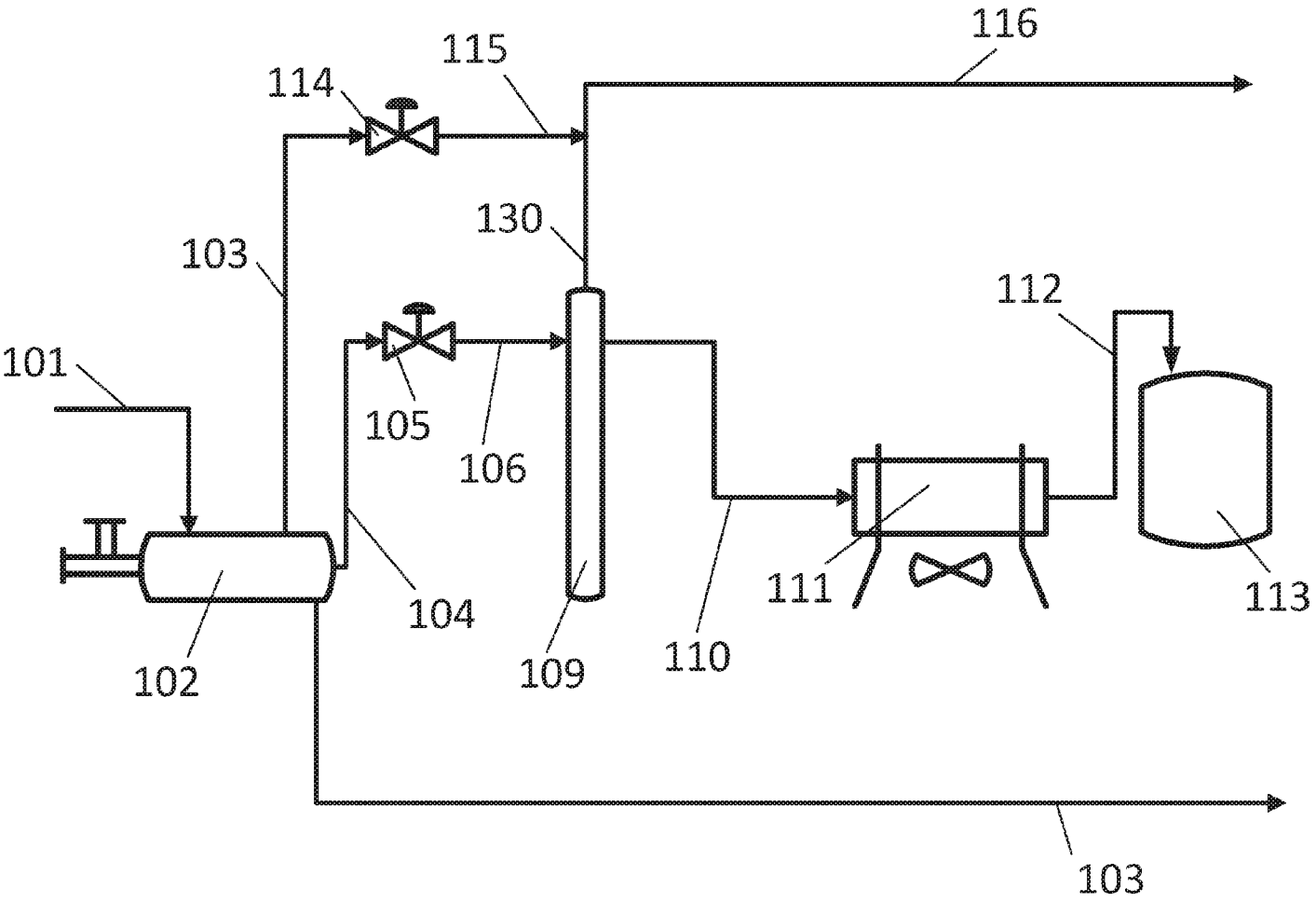
FIG. 2 is a process flow diagram for a COSR system with a vapor recovery tower in accordance with another example of the present invention.

FIG. 2 depicts an embodiment of the COSR process. Crude oil 101 flows into heater-treater 102 where stabilization energy is added to vaporize volatile hydrocarbons and reduce the remaining crude oil volatility. Water 103 is decanted from the bottom of heater-treater 102, and stabilized crude oil 104 is depressurized through valve 105. A two-phase vapor/liquid stream 106 from valve 105 flows into vapor recovery tower 109, where gas separates from crude oil. Crude oil 110 flows from vapor recovery tower 109 through a first partition of air cooler ill. Cooled, stabilized crude oil 112 from partitioned air cooler 111 flows into storage tank 113.

Gas stream 103 from heater treater 102 is depressurized through valve 114. A gas stream 115 from valve 114 is mixed with gas stream 130 from vapor recovery tower 109, forming stream 116. Stream 116 can be compressed into a pipeline or consumed in a combustor.

Alternative Embodiments and Variations

The various embodiments and variations thereof, illustrated in the accompanying figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

For instance, for some embodiments, stabilization energy is added between the heater-treater and the vapor recovery tower. This can be accomplished using a stabilization energy heat source which is operatively connected to the heater-treater. The stabilization energy heat source can be any unit or device which provides the stabilization energy to the crude oil. Although various energy sources can be used, non-limiting examples of suitable energy sources can include heat (e.g. recovered process heat, combustion heat, resistive electrical heating, and the like), acoustic energy (e.g. ultrasound and the like), or other suitable energy sources. Although the exact amount of stabilization energy may vary depending on the application, as a general guideline the stabilization energy can be from about 2,000 to 21,000 BTU per barrel, and in some cases, 7,000 to 13,000 BTU per barrel such as about 10,000 BTU per barrel of oil. Typically, the stabilization energy can heat the crude oil to 125 to 200° F. In one specific example, the stabilization energy source can be the heat source of the heater-treater which is operated at conditions above conventional conditions to break the emulsion. For example, typically the heater-treater can be operated at temperatures of 80 to 120° F. The stabilization energy can be imparted to the crude oil by heating the crude oil within the heater-treater, to raise the crude oil temperature by 10° F. or more, and in some cases by up to 80° F. Regardless of the specific avenue used to impart the stabilization energy, the net effect can be to drive vapor equilibrium sufficient to remove at least 35%, and in many cases at least 90% of the VOC in a controlled condition which can be stored, combusted or otherwise handled, thus reducing or eliminating undesirable residual VOC emissions during storage and transport. More specifically, an enthalpy of unstabilized crude oil prior to exposure to the stabilization energy can be lower than an enthalpy of the stabilized crude oil plus any produced vapor. The resulting stabilized crude oil can often have a vapor pressure less than about 13 psia and in some cases less than about 9 psia at 100° F.

In some embodiments, the stabilization energy can be optional. For example, some raw crude oil may have a low VOC content (i.e. about 10 psia or lower) after standard heater-treater processing. In such cases, the addition of supplemental stabilization energy can be optional. Accordingly, the above recited embodiments can be implemented without the addition of the stabilization energy source. Thus, in accordance with these embodiments, the crude oil can be also be stabilized by recovering and condensing vapors from tank vent gas as described herein.

Some embodiments may not combine the heater-treater gas with the tank vent gas. Other embodiments may use multiple air coolers instead of a partitioned air cooler. In such cases, from two to four air coolers can be typically used, depending on desired cooling load and capacity. Optionally, the heater treater gas may be combined with gas from the primary oil well separator and sent to a flare(s) and NGL recovery unit. Gas from the heater-treater is very rich. Consequently, recovery of the combined vent gas from the crude oil tank in the heater treater is improved because of the higher content of less volatile hydrocarbons. Some embodiments may substitute a two-phase separator where a three-phase separator is indicated, whereby water is separated from the NGL downstream of the COSR unit if necessary. Some embodiments may return all or part of the NGL to the crude oil storage tank.

I claim:

1. A crude oil stabilization and recovery system comprising:

a heater-treater having a crude oil inlet fluidly connected to a wellhead separator and a heater-treater crude oil outlet;

a vapor recovery tower disposed downstream of said heater-treater;

a depressurization valve disposed downstream of said heater-treater crude oil outlet and upstream of said vapor recovery tower;

an air cooler fluidly connected downstream of said vapor recovery tower via a crude oil conduit;

a second air cooler fluidly connected to said vapor recovery tower via the gas from said vapor recovery tower wherein gas from said vapor recovery tower is cooled and partially condensed in the said second air cooler; and a primary separator fluidly connected to said second air cooler and adapted to separate gas, natural gas liquid (NGL), and water.

2. A crude oil stabilization and recovery system of claim 1, wherein said second air cooler is also fluidly connected to said heater treater via gas from said heater treater, and wherein gas from said vapor recovery tower and said heater treater are combined, cooled and partially condensed in said second air cooler.

3. A crude oil stabilization and recovery system of claim 2, further comprising:

a compressor fluidly connected to said primary separator delivering compressed gas to a third air cooler; and a secondary separator fluidly connected to said third air cooler adapted to receive and separate a three-phase mixture of gas, water and NGL.

4. A crude oil stabilization and recovery system of claim 3, further comprising:

a pump fluidly connected to said primary separator configured to deliver NGL and water to said secondary separator.

5. A crude oil stabilization and recovery system comprising:

a heater-treater having a crude oil inlet fluidly connected to a wellhead separator and a heater-treater crude oil outlet;

a vapor recovery tower disposed downstream of said heater-treater;

a crude oil depressurization valve disposed downstream of said heater-treater and upstream of said vapor recovery tower; and an air cooler fluidly connected downstream of said vapor recovery tower via a crude oil conduit.

6. A crude oil stabilization and recovery system comprising:

a heater-treater having a crude oil inlet fluidly connected to a wellhead separator and a heater-treater crude oil outlet;

a vapor recovery tower disposed downstream of said heater-treater;

a depressurization valve disposed downstream of said heater-treater crude oil outlet and upstream of said vapor recovery tower;

a partitioned air cooler having a first partition fluidly connected downstream of said vapor recovery tower via a crude oil conduit, the partitioned air cooler having a second partition fluidly connected to said vapor recovery tower via the gas from said vapor recovery tower wherein gas from said vapor recovery tower is cooled and partially condensed in the said second partition; and a primary separator fluidly connected to said second partition air cooler and adapted to separate gas, natural gas liquid (NGL), and water.

* * * * *